US007053321B2

(12) United States Patent
Leccia et al.

(10) Patent No.: US 7,053,321 B2
(45) Date of Patent: May 30, 2006

(54) APPARATUS OPERATING AN ISOLATION SWITCH IN COORDINATION WITH A CIRCUIT BREAKER

(75) Inventors: Brad R. Leccia, Bethel Park, PA (US); Paul A. Colbaugh, Allison Park, PA (US)

(73) Assignee: Eaton Corporation, Cleveland, OH (US)

( * ) Notice: Subject to any disclaimer, the term of this patent is extended or adjusted under 35 U.S.C. 154(b) by 509 days.

(21) Appl. No.: 10/410,811

(22) Filed: Apr. 10, 2003

(65) Prior Publication Data

US 2004/0201285 A1 Oct. 14, 2004

(51) Int. Cl.
*H01H 3/16* (2006.01)
*H01H 9/00* (2006.01)

(52) U.S. Cl. ..... 200/50.1; 200/50.28; 200/50.01; 361/605; 361/608; 335/24; 335/68

(58) Field of Classification Search ..... 200/50.01, 200/50.04, 50.05, 50.11, 50.12, 50.18, 50.1, 200/50.3, 50.28, 50.21, 50.22, 50.23, 50.24, 200/50.25, 50.26, 50.27; 361/605, 606, 607, 361/608–610, 615; 335/22, 24, 68–72
See application file for complete search history.

(56) References Cited

U.S. PATENT DOCUMENTS 4,286,242 A 8/1981 Mrenna et al.
4,677,269 A * 6/1987 Tringali ..... 200/324
5,023,469 A 6/1991 Bassett et al.
5,081,367 A * 1/1992 Smith et al. ..... 307/64
5,436,415 A 7/1995 Smith et al.
5,581,133 A * 12/1996 Smith et al. ..... 307/64
5,895,898 A * 4/1999 Godesa ..... 200/50.32
5,914,467 A 6/1999 Jonas et al.
6,066,814 A * 5/2000 Smith et al. ..... 200/50.24
6,160,228 A * 12/2000 Gerbert-Gaillard et al. ..... 200/50.21
6,329,615 B1 12/2001 Biquez
6,388,214 B1 * 5/2002 Jones et al. ..... 200/50.33
6,442,452 B1 8/2002 Kopke
6,445,570 B1 * 9/2002 Leccia ..... 361/605

* cited by examiner

*Primary Examiner*—Elvin G. Enad
*Assistant Examiner*—Lheiren Mae A. Anglo
(74) *Attorney, Agent, or Firm*—Martin J. Moran

(57) ABSTRACT

The movable conductors of a three phase isolation switch are incorporated into the electrically insulative molded shaft, thereby mechanically supporting them and isolating them from the metal axle of the shaft. Movable contacts on the ends of each movable conductor are angularly spaced by α degrees, where α is less than 180° and is 90° in the exemplary embodiment. A common fixed load contact is located angularly between, and spaced α degrees from, both the fixed line and ground contacts so that the shaft is rotated only α degrees between a first, closed position, in which the movable conductors connect the fixed load contact for each phase to the corresponding fixed line contact, and a second, grounded position, where the fixed load contact of each phase is connected by the movable conductor to the corresponding fixed ground contact.

19 Claims, 5 Drawing Sheets

APPARATUS OPERATING AN ISOLATION SWITCH IN COORDINATION WITH A CIRCUIT BREAKER

BACKGROUND OF THE INVENTION

1. Field of the Invention

This invention relates generally to the distribution of electric power and particularly to apparatus that operates an isolation switch in coordination with a circuit breaker with which it is used.

2. Background Information

The feeder circuits in an electric power distribution system are connected to a power source through power circuit breakers which provide protection and can isolate the feeder lines for maintenance. An isolation switch can be used in combination with the power circuit breaker to ground the feeder to assure that it is safe to work on. Where the isolation switch is provided on the line side of the circuit breaker, it is important that the circuit breaker be open when the isolation switch is being switched to the grounded position. The circuit breaker can then be reclosed to ground the feeder line for maintenance. It is important, therefore, to coordinate the operation of the isolation switch with that of the circuit breaker.

Ideally, the isolation switch is located adjacent the power conductors at the rear of the circuit breaker. In addition, multiple circuit breakers can be stacked one on a top of another and side-by-side in a switch gear assembly. Thus, little room is available for operating the isolation switches from the front of the switch gear assembly.

SUMMARY OF THE INVENTION

It is an object of the present invention to provide apparatus for coordinating the operation of an isolation switch with that of a circuit breaker with which it is used.

It is another object of the invention to provide apparatus for operating an isolation switch that is located behind a circuit breaker and for mechanically interlocking the operation of the isolation switch with the operation of the circuit breaker.

Thus, the present invention is directed to apparatus for operating an isolation switch in coordination with a circuit breaker comprising a drive assembly that includes a driven member and a drive coupling coupling the isolation switch to the driven member for movement of the isolation switch between open, isolated and grounded positions with movement of the driven member between corresponding positions. The apparatus further includes an interlock assembly that interlocks movement of the driven member with the condition of the circuit breaker. More particularly, the interlock assembly includes an interlock member having a lock position in which the interlock member prevents movement of the driven member, and therefore, the isolation switch and an unlock position in which the driven member is free to move. The interlock assembly further includes an interlock coupler coupling the interlock member to the circuit breaker for movement of the interlock member to the lock position when the circuit breaker is closed and to the unlock position when the circuit breaker is in the open condition.

The drive assembly can further include a driving member moving the driven member between the closed, isolated, and open positions, and the interlock assembly can include a blocking member that blocks access to the driving member when the interlock member is in the lock position.

The driving member can move the driven member along a reciprocal path in which case the interlock assembly includes a mount mounting the interlock member for movement into the reciprocal path of the driven member in the lock position to prevent movement of the driven member. The interlock member can have edges formed by fingers that prevent the reciprocal movement of the driven member. Where the reciprocal path is linear, the interlock member is mounted for pivotal movement into and out of the lock position about a pivot axis substantially parallel to the linear path. In this case also, the driving member can be a threaded shaft on which the driven member is threaded for the reciprocal movement along the linear path.

The drive coupling can comprise cables connecting the driven member to the isolation switch. A position indicator can be provided such as a pointer carried by the cable for movement relative to a stationary legend indicating switch position.

BRIEF DESCRIPTION OF THE DRAWINGS

A full understanding of the invention can be gained from the following description of the preferred embodiments when read in conjunction with the accompanying drawings in which.

DESCRIPTION OF THE PREFERRED EMBODIMENTS

Figure 1:
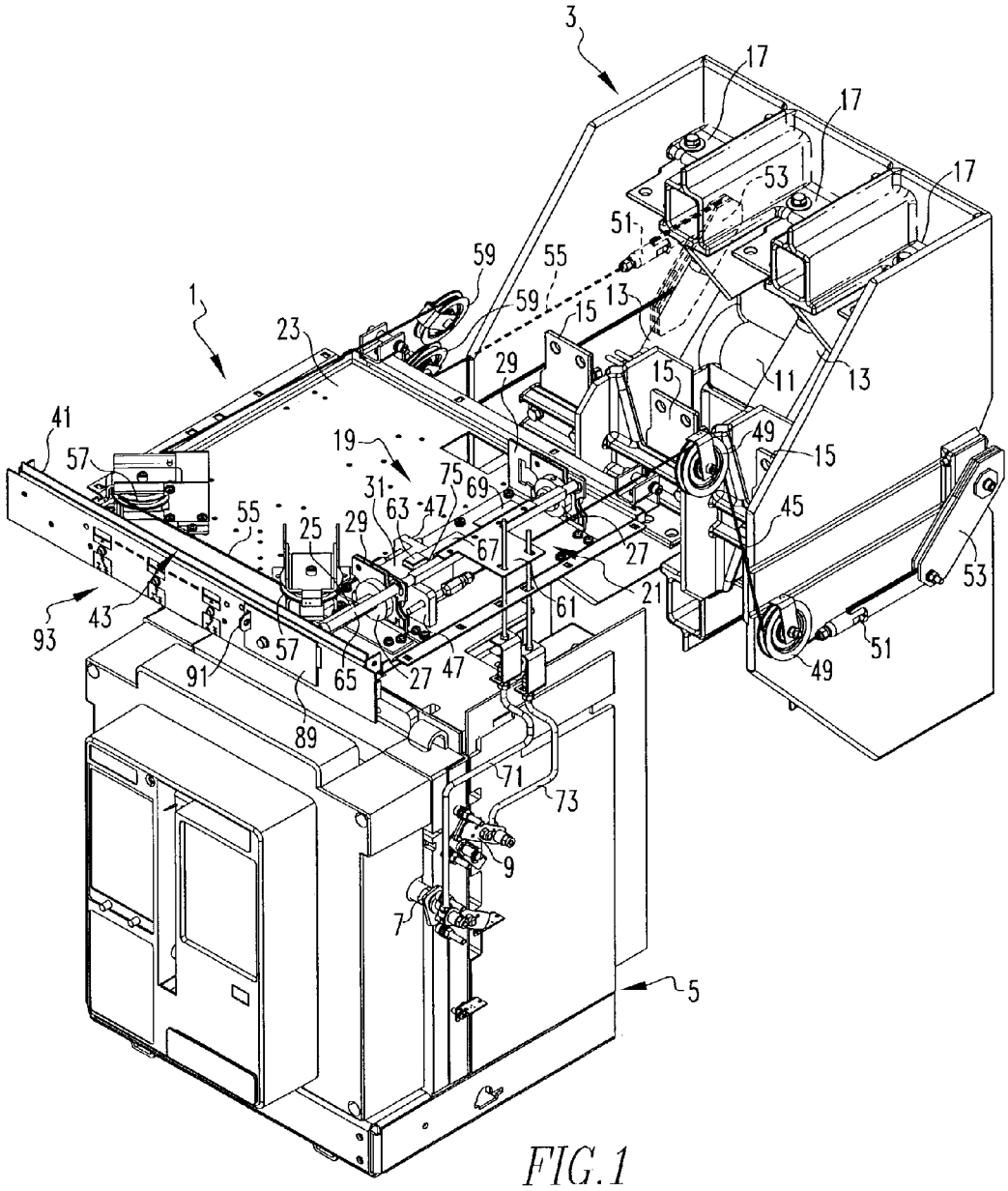
FIG. 1 is an isometric view of apparatus in accordance with the invention for operating an isolation switch in coordination with circuit breaker operation shown with the isolation switch in the closed position and the interlock in the lock position.

As shown in FIG. 1, apparatus in the form of a drive/interlock unit 1 operates an isolation switch 3 in coordination with a power circuit breaker 5. As is common, the power circuit breaker 5 has an output 7 which indicates the open and closed position of the circuit breaker contacts. An auxiliary trip bar 9 on the side of the power circuit breaker 5 holds the breaker in the tripped open position when actuated.

The isolation switch 3 may be of the type described in commonly owned U.S. patent application Ser. No. 10/241,122, filed on Sep. 11, 2002. This switch 3 has a shaft 11 carrying a moveable conductor 13 for each phase. A set of terminals 15 is connected by buses (not shown) to corresponding terminals (not shown) on the back of the circuit breaker 5. A second set of terminals 17 is connected to a power source (not shown). An additional set of terminals (not shown) underneath the isolation switch 3 are connected to ground. Rotation of the shaft 11 selectively connects the circuit breaker 5 to the source or ground. In a third, intermediate position in which the moving conductors are between the terminals, the circuit breaker is isolated. Thus, the shaft 11 of the isolation switch 3 is reciprocally rotatable between a closed position, an isolated position, and a grounded position.

Figure 2:
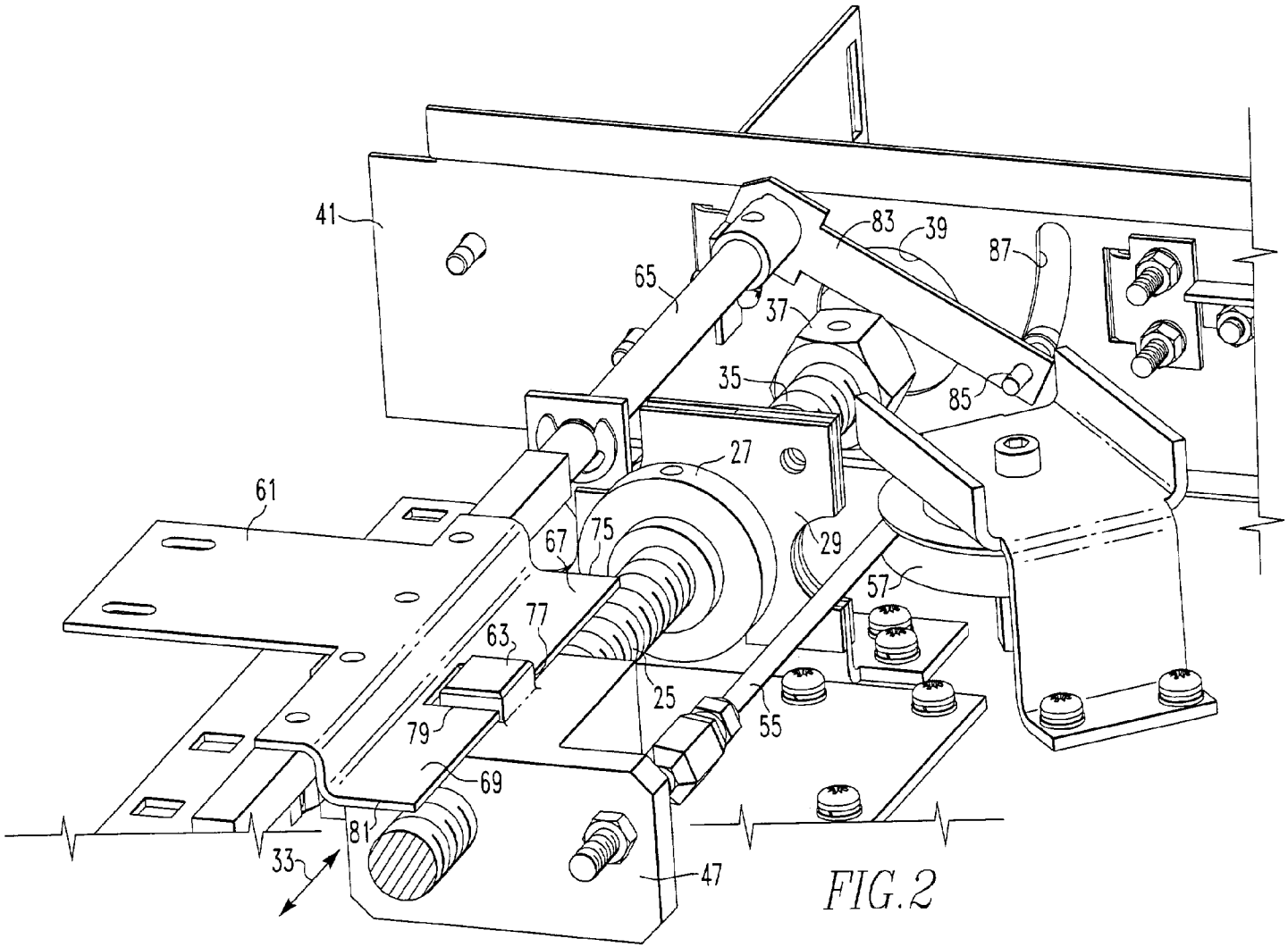
FIG. 2 is a partial isometric view of the drive/interlock unit of the invention shown with the isolation switch in the isolated position and the interlock in the lock position.
Figure 3:
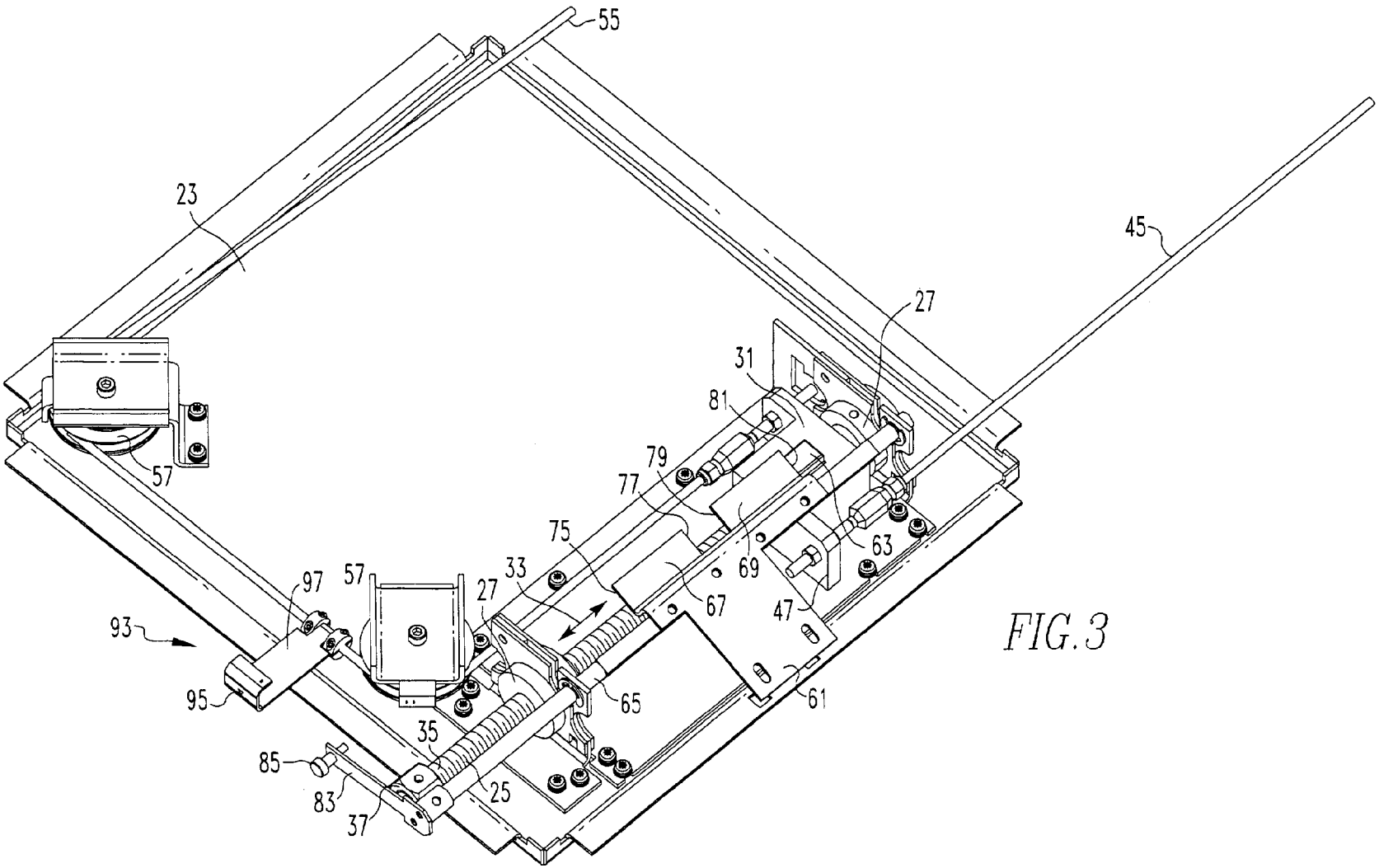
FIG. 3 is an isometric view of the drive/interlock unit with the isolation switch in the grounded position and the interlock in the unlock position.
Figure 4:
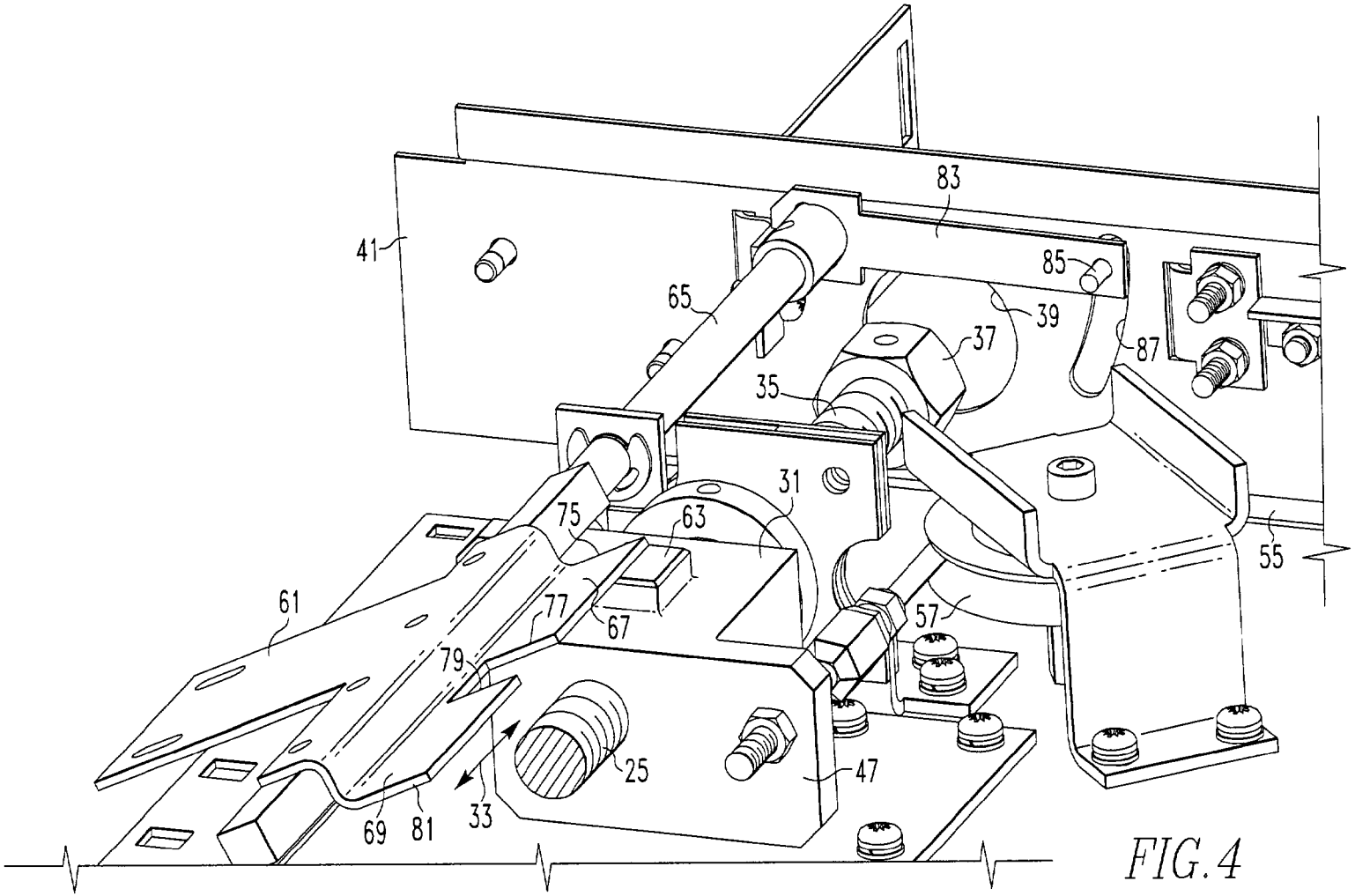
FIG. 4 is a partial isometric view of the drive/interlock unit shown with the isolation switch in the close position and the interlock in the unlock position.

As the isolation switch 3 is located behind the circuit breaker 5, the drive/interlock unit 1 allows the switch to be manually operated from a position in front of the circuit breaker 5. Referring also to FIGS. 2–4, this drive/interlock unit 1 includes a drive assembly 19 and interlock assembly 21, both mounted on a support platform 23. The drive assembly 19 includes a driving member in the form of a threaded shaft 25 journaled in bearings 27 supported by L-shaped brackets 29 mounted on a support platform 23. A driven member 31 is threaded on the threaded shaft 25 for reciprocal movement along a linear path 33. One end (the forward end) 35 of the threaded shaft is provided with a drive connection in the form of a hex head 37. This hex head 37 can be accessed through an opening 39 and a front panel 41. See FIGS. 2 and 3. The hex head 37 can be engaged by a tool (not shown) to rotate the shaft 25 and thereby reciprocate the driven member 31 along the linear path 33.

The drive assembly 19 also includes a drive coupling 43 coupling the driven member 31 to the shaft 11 of the isolation switch. The drive coupling 43 includes a first cable 45 connected at one end to a flange 47 on the driven member and which passes around a pair of guide pulleys 49 and is connected through a connector 51 to a lever 53 secured to the one end of the shaft 11. A second cable 55 is connected to another flange 47 on the opposite side of the driven member 31 and passes around a second pair of guide pulleys 57 to reverse its direction and then passes over a third pair of guide pulleys 59 and is secured by another connector 51 to a second lever 53 on the opposite end of the switch shaft 11. This second lever 53 is diametrically opposite the first lever so that when the driven member 31 moves upward and to the right as shown in FIG. 1 along the threaded shaft 25, the second cable 55 rotates the shaft 11 counterclockwise as viewed in FIG. 1. As can be appreciated from viewing FIG. 1, when the driven member 31 moves down and to the left to the position shown, the first cable 45 rotates the shaft 11 clockwise.

Operation of the isolation switch needs to be coordinated with operation of the circuit breaker. This coordination requires that the following conditions be met:

1. If the circuit breaker is closed, then the switch cannot change positions.
2. If the switch is between positions, then the circuit breaker must remain open/trip free.
3. If the switch is in any one of its three positions, then the circuit breaker position can be open or closed or open/trip free.

The interlock assembly 21 coordinates the operation of the isolation switch 3 with the condition of the circuit breaker 5. The interlock assembly 21 includes an interlock member in the form of a plate 61. The plate 61 is mounted for movement into and out of the linear path 33 followed by a projection or boss 63 on the driven member 31. This is accomplished by mounting the interlock plate 61 on a pivot shaft 65 mounted parallel to the threaded shaft 25 so that the interlock plate pivots into and out of the linear path 33 followed by the boss 63. The interlock plate 61 has a pair of fingers 67 and 69 projecting laterally from the pivot shaft 65 with the side edges of these fingers forming abutment surfaces. The fingers 67 and 69 are sized and spaced such that the interlock plate 61 can only be rotated into the linear path 33 of the boss 63 and, therefore, the driven member 31 when the latter is in one of the closed, isolated and grounded positions.

Referring again to FIG. 1, the interlock assembly also includes an interlock coupler formed by a pair of push-pull cables 71 and 73 each connected at one end to the interlock plate 61. The push-pull cable 71 has its other end connected to the output 7 of the circuit breaker 5. When the circuit breaker 5 is in the closed condition, the push-pull cable 71 rotates the interlock plate 61 into the path 33 of the boss 63 on the driven member 31. With the circuit breaker closed and, therefore, the interlock plate member 61 in the lock position as shown in FIG. 1, the position of the isolation switch 3 cannot be changed thus, as shown in FIG. 1 with the isolation switch closed, a first abutment surface 75 on the outside of the finger 67 prevents movement of the driven member. Similarly, with the isolation switch 3 in the isolated position as shown in FIG. 2, the facing edges on the fingers 67 and 69 form a second abutment surface 77 and third abutment surface 79 which prevent movement of the driven member. With the isolation switch in the grounded position shown in FIG. 3, the outer edge on the finger 69 forms a fourth abutment surface 81 that blocks movement of the driven member 31.

In order to change the position of the isolation switch 3, the circuit breaker must be in the open condition so that the interlock plate 61 is rotated to the unlock position out of the path 33 of the boss 63 as shown in FIG. 4. Rotation of the interlock plate 61 to the unlock position causes the second push-pull cable 73 to actuate the auxiliary trip lever 9 on the circuit breaker 5 to hold the circuit breaker in the tripped open position so that it cannot be closed while the position of the isolation switch is being changed.

The interlock assembly 21 also includes a blocking member in a form of a lever 83 on the end of the pivot shaft 65 which is at least in partial axial alignment with the hex head 37 thereby blocking access to the hex head when the interlock plate 61 is in the lock position as shown in FIG. 2. Therefore, in order to change the position of the isolation switch, the lever 83 must be rotated out of alignment with the hex head, but this only occurs when the circuit breaker is open so that the interlock plate 61 is rotated to the unlock position as can be seen in FIG. 4. A guide pin 85 on the free end of the lever 83 rides in a slot 87 in the panel 41 to stabilize the lever 83. As a further precaution, a hinged access door 89 can be secured over the opening 39 as shown in FIG. 1 and held in place by lock (not shown) through the hasp 91.

Figure 5:
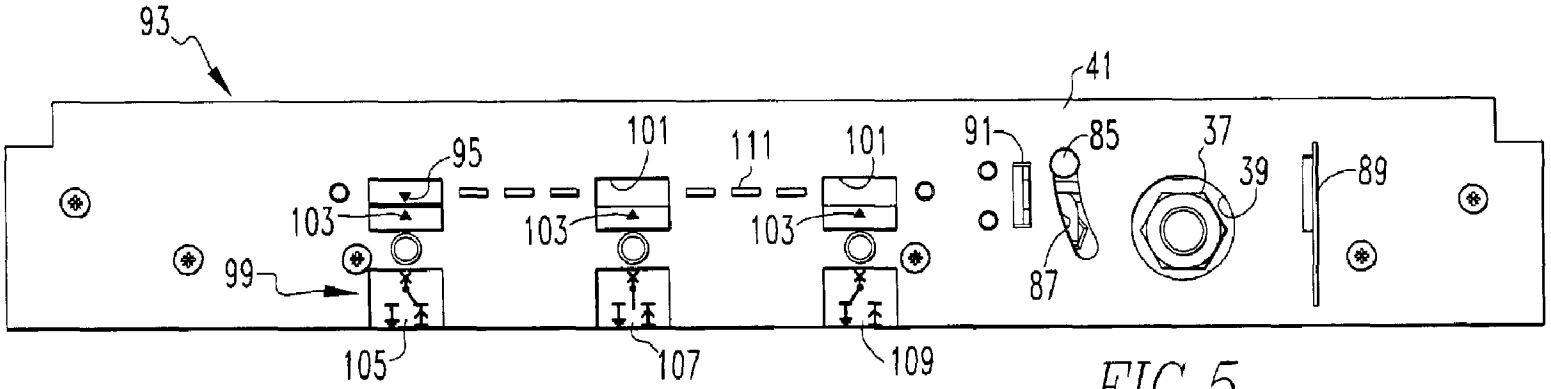
FIG. 5 is a front view of the drive/interlock unit in which the position indicator illustrates the isolation switch in the closed position and the drive mechanism indicates that the interlock is in the unlock position.
Figure 6:
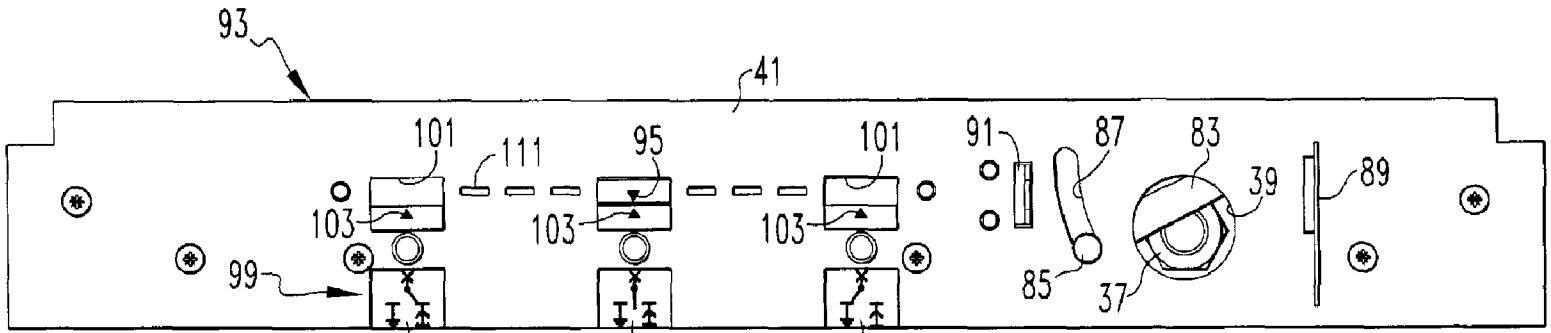
FIG. 6 is similar to FIG. 5 illustrating the isolation switch in the isolated position and with the interlock in the lock position.

As the isolation switch is located behind the drive/interlock unit 1 and the circuit breaker 5, a position indicator 93 is provided so that the operator is able to determine at any time the position of the isolation switch. This position indicator 93 includes a pointer 95 inscribed on a bracket 97 carried by the cable 55 as can be seen in FIG. 3. The position indicator 93 also includes a legend 99 provided on the face plate 41 adjacent slots 101 in the face plate 41 at the positions assumed by the pointer 95 for the closed, isolated and grounded positions of the isolation switch 3. The legend 99 includes a fixed pointer 103 at each of these positions and a representation 105, 107 and 109 of the closed, isolated and grounded position of the isolation switch. Additional slots 111 reveal the position of the moveable pointer 95, and therefore, the position of the isolation switch during transition between the closed, isolated and grounded positions. FIG. 5 illustrates the condition of the position indicator 93 with the isolation switch in the closed position and the interlock member in the unlock position as shown in FIG. 4. FIG. 6 illustrates the condition of position indicator 93 with the isolation switch in the isolated position as shown in FIG. 2 with the interlock member in the lock position as indicated by the position of the locking lever 83 preventing access to the hex nut 37 of the drive unit.

While specific embodiments of the invention have been described in detail, it will be appreciated by those skilled in the art that various modifications and alternatives to those details could be developed in light of the overall teachings of the disclosure. Accordingly, the particular arrangements disclosed are meant to be illustrative only and not limiting as to the scope of the invention which is to be given the full breadth of the claims appended and any and all equivalents thereof.

What is claimed is:

1. Apparatus for operating an isolation switch having a closed position, an isolated position, and a grounded position in coordination with a circuit breaker having a closed condition, an open condition, and a tripped open condition, the apparatus comprising:

a drive assembly comprising;

a driven member having a closed position, an isolated position, and a grounded position corresponding to the closed position, isolated position, and grounded position of the isolation switch; and a drive coupling, coupling the isolation switch to the driven member for movement of the isolation switch between the closed position, the isolated position, and a grounded position with movement of the driven member between the closed position, the open position, and the grounded position;

an interlock assembly interlocking movement of the driven member with the condition of the circuit breaker.

2. The apparatus of claim 1, wherein the interlock assembly comprises an interlock member having a lock position in which the interlock member prevents movement of the driven member and an unlock position in which the driven member is free to move between the closed position, the isolated position, and the grounded position, and an interlock coupler coupling the interlock member to the circuit breaker for movement of the interlock member to the lock position when the circuit breaker is in the closed condition and to the unlock position when the circuit breaker is in the open condition.

3. The apparatus of claim 2, wherein the drive assembly comprises a driving member moving the driven member between the closed position, the isolated position, and the open position, and the interlock assembly comprises a blocking member blocking access to the driving member when the interlock member is in the lock position.

4. The apparatus of claim 3, wherein the blocking member is manually movable to unblock access to the driving member and is coupled to the interlock member to simultaneously move the interlock member to the unlock position, the interlock coupler including a connection holding the circuit breaker to the tripped open condition with the interlock member in the unlock position.

5. The apparatus of claim 2, wherein the drive assembly comprises a driving member driving the driven member along a reciprocal path between the closed, the isolated, and the grounded positions, and wherein the interlock assembly includes a mount mounting the interlock member for movement into the reciprocal path of the driven member in the lack position of the interlock member to prevent movement of the driven member along the reciprocal path.

6. The apparatus of claim 5, wherein the interlock member has a first edge that blocks movement of the driven member out of the closed position, second and third edges that block movement of the driven member out of the isolated position, and a fourth edge that blocks movement of the driven member out of the grounded position, the first through fourth edges blocking movement of the driven member when the interlock member is in the lock position.

7. The apparatus of claim 6, wherein the reciprocal path is a linear path and the mount comprises a pivotal mount mounting the interlock member for pivotal movement into and out of the lock position about a pivot axis substantially parallel to the linear path.

8. The apparatus of claim 7, wherein the interlock member comprises a pair of fingers extending laterally outward from the pivotal mount with facing edges of the pair of fingers forming the second and third edges and outside edges of the pair of fingers forming the first and fourth edges.

9. The apparatus of claim 8, wherein the pivotal mount comprises a pivot shaft and the interlock member comprises a plate member mounted on the pivot shaft and extending in a plane substantially parallel to the pivot shaft with the fingers formed in the plate member and extending generally away from the pivot shaft.

10. The apparatus of claim 9, wherein the driving member is a threaded shaft on which the driven member is threaded for reciprocal movement along the linear path, the threaded shaft extending substantially parallel to the pivot shaft.

11. The apparatus of claim 10, wherein the threaded shaft terminates at one end in a drive connection for rotating the threaded shaft to drive the driven member along the linear path, and the interlock assembly includes a blocking member carried by the pivot shaft and rotatable into a blocking position blocking access to the drive connection when the plate member is pivoted into the lock position.

12. The apparatus of claim 11, wherein the blocking member comprises an arm extending laterally outward from the pivot shaft and which rotates into at least partial axial alignment with the one end of the threaded shaft with the plate member in the lock position.

13. The apparatus of claim 12, wherein the pivot shaft is manually rotatable out of the lock position to uncover the drive connection for engagement of the drive connection to rotate the threaded shaft and move the driven member along the linear path, and the circuit breaker coupler includes a connecting member between the plate member and the circuit breaker that holds the circuit breaker in the tripped open condition when the plate member is pivoted out of the lock position.

14. The apparatus of claim 5, wherein the interlock member comprises a pair of fingers with facing edges of the pair of fingers forming the second and third edges and outside edges of the pair of fingers forming the first and fourth edges.

15. The apparatus of claim 5, wherein the reciprocal path is a linear path and the driving member comprises a treaded shaft on which the driven member is threaded for movement along the linear path through rotation of the threaded shaft.

16. The apparatus of claim 15, wherein the drive assembly further comprises a position indicator providing a visual indication of the position of the isolation switch.

17. The apparatus of claim 16, wherein the drive coupling comprises cables connecting the isolation switch to the driven member and the position indicator comprises a pointer carried by the cables and a stationary legend representing the closed, isolated and grounded positions of the isolation switch relative to which the pointer moves.

18. The apparatus of claim 5, structured for use with the isolation switch having a reciprocally rotatable switch shaft and wherein the drive coupling comprises a first cable connected to the driven member and to the switch shaft to rotate the switch shaft in a first angular direction as the driven member moves in a first direction, and a second cable connected to the driven member and to the switch shaft to rotate the switch shaft in a second angular direction as the driven member moves in a second direction.

19. The apparatus of claim 18, wherein the drive assembly further includes a position indicator comprising a pointer carried by one of the first and second cables and a stationary legend relative to which the pointer moves to indicate the closed, isolated and grounded positions of the isolation switch.

* * * * *